US010808490B2

(12) United States Patent
Giroux

(10) Patent No.: US 10,808,490 B2
(45) Date of Patent: Oct. 20, 2020

(54) BUOYANT SYSTEM FOR INSTALLING A CASING STRING

(71) Applicant: Weatherford Technology Holdings, LLC, Houston, TX (US)

(72) Inventor: Richard Lee Giroux, Bellville, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/982,151

(22) Filed: May 17, 2018

(65) Prior Publication Data

US 2019/0352994 A1 Nov. 21, 2019

(51) Int. Cl.

| | |
|---|---|
| ***E21B 33/12*** | (2006.01) |
| ***E21B 29/00*** | (2006.01) |
| ***E21B 34/06*** | (2006.01) |

(52) U.S. Cl.

CPC ..... *E21B 33/1208* (2013.01); *E21B 29/00* (2013.01); *E21B 34/063* (2013.01)

(58) Field of Classification Search

CPC ..... E21B 34/063; E21B 33/1208; E21B 33/14
See application file for complete search history.

(56) References Cited

U.S. PATENT DOCUMENTS

| | | | |
|---|---|---|---|
| 1,884,165 | A | 10/1932 | Otis |
| 2,560,901 | A | 7/1951 | Smith |
| 2,565,731 | A | 8/1951 | Johnston |
| 3,445,032 | A | 5/1969 | Saeki et al. |
| 3,620,799 | A | 11/1971 | Hoelscher et al. |
| 3,831,680 | A | 8/1974 | Edwards et al. |
| 4,602,731 | A | 7/1986 | Dockus |
| 4,658,902 | A | 4/1987 | Wesson et al. |
| 4,911,987 | A | 3/1990 | Sakata et al. |
| 5,082,739 | A | 1/1992 | Roy et al. |
| 5,479,986 | A | 1/1996 | Gano et al. |
| 5,607,017 | A | 3/1997 | Owens et al. |
| 5,685,372 | A | 11/1997 | Gano |
| 5,765,641 | A | 6/1998 | Shy et al. |
| 5,924,696 | A | 7/1999 | Frazier |
| 5,947,204 | A | 9/1999 | Barton |
| 6,026,903 | A | 2/2000 | Shy et al. |
| 6,076,600 | A | 6/2000 | Vick, Jr. et al. |

(Continued)

FOREIGN PATENT DOCUMENTS

| | | | |
|---|---|---|---|
| WO | 2009116871 | A1 | 9/2009 |
| WO | 2016046533 | A1 | 3/2016 |

(Continued)

OTHER PUBLICATIONS

"Body" definition available from: https://www.merriam-webster.com/dictionary/body (Year: 2020).*

(Continued)

*Primary Examiner* — Robert E Fuller
*Assistant Examiner* — Theodore N Yao
(74) *Attorney, Agent, or Firm* — Patterson + Sheridan, LLP

(57) ABSTRACT

In one embodiment, a sealing device includes a tubular body having a bore; a collet seat having a plurality of collets; a frangible sealing element disposed in the collet seat and blocking fluid communication through the bore; and a releasable sleeve releasably attached to the tubular body and retaining the collet seat against the tubular body.

21 Claims, 9 Drawing Sheets

(56) References Cited

U.S. PATENT DOCUMENTS

| | | | |
|---|---|---|---|
| 6,182,704 | B1 | 2/2001 | Bevacco |
| 6,472,068 | B1 | 10/2002 | Glass et al. |
| 7,513,311 | B2 | 4/2009 | Gramstad et al. |
| 7,665,528 | B2 | 2/2010 | Ross et al. |
| 7,699,113 | B2 | 4/2010 | Ring |
| 7,712,521 | B2 | 5/2010 | Sorensen |
| 7,806,189 | B2 | 10/2010 | Frazier |
| 7,909,104 | B2 | 3/2011 | Bjorgum |
| 7,963,340 | B2 | 6/2011 | Gramstad et al. |
| 8,322,448 | B2 | 12/2012 | Brandsdal |
| 8,397,813 | B2 | 3/2013 | Brandsdal |
| 8,813,848 | B2 | 8/2014 | Frazier |
| 9,194,209 | B2 | 11/2015 | Frazier |
| 9,222,322 | B2 | 12/2015 | Brandsdal |
| 9,291,031 | B2 | 3/2016 | Frazier |
| 9,353,596 | B2 | 5/2016 | Raggio |
| 9,382,778 | B2 | 7/2016 | Frazier |
| 9,464,497 | B2 | 10/2016 | Kekarainen |
| 9,593,542 | B2 | 3/2017 | Getzlaf et al. |
| 9,657,547 | B2 | 5/2017 | Raggio |
| 9,708,884 | B2 | 7/2017 | Epstein |
| 9,732,579 | B2 | 8/2017 | Hiorth et al. |
| 9,739,114 | B2 | 8/2017 | Frazier |
| 10,000,991 | B2 | 6/2018 | Harris et al. |
| 10,465,468 | B2 | 11/2019 | Frazier et al. |
| 2003/0168214 | A1 | 9/2003 | Sollesnes |
| 2011/0284242 | A1 | 11/2011 | Frazier |
| 2013/0228338 | A1 | 9/2013 | Brandsdal |
| 2014/0008085 | A1 | 1/2014 | Tinnen |
| 2014/0216756 | A1 | 8/2014 | Getzlaf et al. |
| 2015/0068730 | A1 | 3/2015 | Frazier |
| 2015/0211321 | A1 | 7/2015 | Wee |
| 2016/0281455 | A1 | 9/2016 | Brandsdal et al. |
| 2016/0369582 | A1 | 12/2016 | Bar et al. |
| 2017/0022783 | A1* | 1/2017 | Yong ..... E21B 34/063 |
| 2017/0096875 | A1* | 4/2017 | Ravensbergen ..... E21B 17/00 |
| 2018/0371869 | A1 | 12/2018 | Kellner et al. |
| 2019/0153816 | A1 | 5/2019 | Campbell |

FOREIGN PATENT DOCUMENTS

| | | | |
|---|---|---|---|
| WO | 2016195508 | A1 | 12/2016 |
| WO | 2017034416 | A1 | 3/2017 |

OTHER PUBLICATIONS

Fike Corporation, Fike Pad (Pressure Activation Device), Form No. OTB 20320799 Brochure, Copyright 1999. (2 total pages).

Fike Corporation, Well Test Membrane, Form No. OTB 20310599 Brochure, Copyright 1999. (2 total pages).

Magnum Oil Tools: Single Inverventionless Magnumdisk Brochure; Copyright 2015 (Rev—Feb. 9, 2016) (2 pages total.).

Magnum Oil Tools: Magnum's Single Magnum Disk Frangible Knockout Isolation Sub Brochure (2 pages total.).

U.S. Pat. No. 7,806,189, Frazier, Oct. 5, 2010, Continuity Data.

Giroux et al.; Buoyant System for Installing a Casing String; U.S. Appl. No. 16/408,742, filed May 10, 2019 (Application not attached to IDS.).

Non-Final Rejection in U.S. Appl. No. 16/408,742 dated Nov. 26, 2019.

* cited by examiner

BUOYANT SYSTEM FOR INSTALLING A CASING STRING

BACKGROUND

Field

Embodiments of the present disclosure generally relate to running a casing string into a wellbore.

Description of the Related Art

In extended reach wells or wells with complex trajectory, operators often experience difficulty in running a liner/casing past a certain depth or reach. The depth or reach of the liner is typically limited by the drag forces exerted on the liner. If further downward force is applied, the liner may be pushed into the sidewall of the wellbore and become stuck or threaded connections in the liner may be negatively impacted. As a result, the liners are prematurely set in the wellbore, thereby causing hole downsizing.

Various methods have been developed to improve liner running abilities. For example, special low friction centralizers or special fluid additives may be used to reduce effective friction coefficient. In another example, floating a liner against the wellbore may be used to increase buoyancy of the liner, thereby reducing contact forces.

There is a need, therefore, for apparatus and methods to improve tubular running operations.

SUMMARY

In one embodiment, a sealing device includes a tubular body having a bore; a collet seat having a plurality of collets; a frangible sealing element disposed in the collet seat and blocking fluid communication through the bore; and a releasable sleeve releasably attached to the tubular body and retaining the collet seat against the tubular body.

In another embodiment, a sealing device includes a tubular body having a bore; a frangible sealing element disposed in the tubular body and blocking fluid communication through the bore; an aperture formed in the sealing element; and a rupture device selectively blocking fluid communication through the aperture.

In another embodiment, a tubular assembly disposed in a wellbore, includes a tubular string having a bore; a sealing device as described herein disposed in the tubular string and blocking fluid flow through the bore; a valve assembly disposed in the tubular string and downstream from the sealing device, the valve assembly blocking fluid flow through the bore; a buoyant chamber formed between the sealing device and the valve assembly, the buoyant chamber including a fluid having a lower specific gravity than a fluid in the wellbore.

In another embodiment, a tubular assembly disposed in a wellbore includes a tubular string having a bore; a lower sealing device disposed in the tubular string and blocking fluid flow through the bore; an upper sealing device disposed in the tubular string and located upstream from the lower sealing device, the upper sealing device blocking fluid flow through the bore.

In one embodiment, the upper sealing device includes a tubular body having a bore; a frangible sealing element disposed in the tubular body and blocking fluid communication through the bore of the tubular body, the sealing element includes a dome having a concave surface oriented toward the lower sealing device; and a buoyant chamber formed between the lower sealing device and a upper sealing device, the buoyant chamber including a fluid having a lower specific gravity than a fluid in the wellbore.

In another embodiment, a method of installing a tubular string in a wellbore includes forming a buoyant chamber between a sealing device and a valve assembly disposed in the tubular string. The sealing device includes a tubular body having a bore; a frangible sealing element disposed in the tubular body and blocking fluid communication through the bore of the tubular body, the sealing element includes a dome and an aperture formed through the dome; and an aperture formed through the dome, the aperture blocked from fluid communication. The method also includes supplying the buoyant chamber with a fluid having a lower specific gravity than a fluid in the wellbore; moving the tubular string along the wellbore; applying pressure to open the aperture for fluid communication; and flowing fluid through the aperture to break the sealing element.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 2 also illustrates an exemplary embodiment of a lower sealing device.

DETAILED DESCRIPTION

Figure 1:
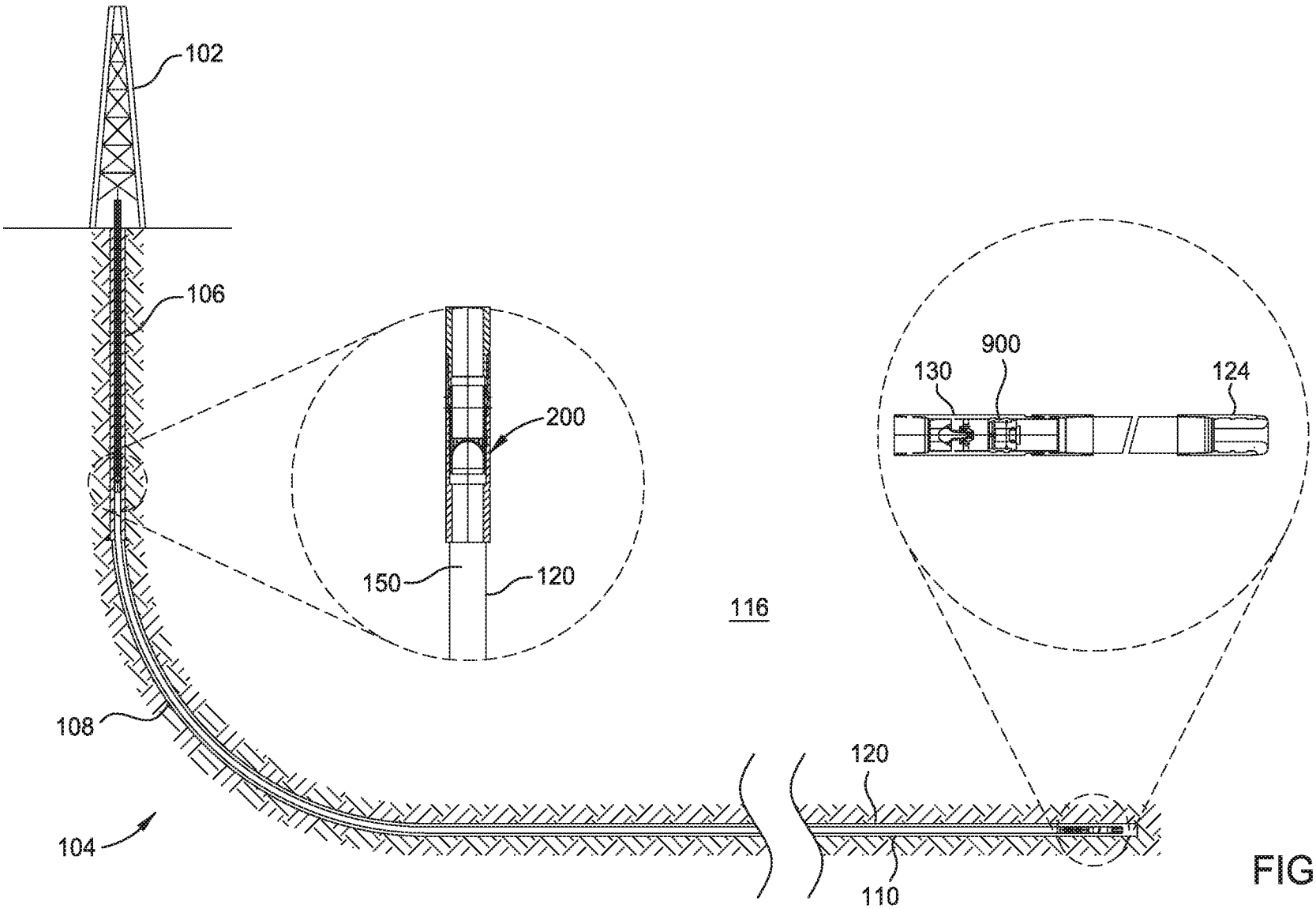
FIG. 1 is a schematic view of a wellbore having a casing string equipped with a sealing device and a valve assembly, according to some embodiments.

FIG. 1 is a schematic side view of a wellbore 104. A drilling rig 102 on the surface has been used to drill a wellbore 104 into the earth 116. The wellbore 104 includes a vertical section 106. Thereafter, a drill bit may be maneuvered to form a diverging section 108 of the wellbore 104. The drill bit may be maneuvered to ultimately form a horizontal section 110 of the wellbore 104. Such horizontal wellbores 110 can enable a single drilling rig 102 to access a relatively large region of a particular geological formation at the depth of the horizontal section 110 of the wellbore 104.

After the wellbore or a portion of the wellbore 104 has been drilled, a casing string is typically installed. The casing string is typically made up of a series of metal pipes (i.e., casing sections) that are connected together end to end. After the casing string has been placed in the wellbore, cement is pumped through the casing string to a distal end of the casing string. From there, the cement can flow back toward the surface of the well through an annular gap between the wellbore and the casing string. The cement cures to seal the annular gap.

Figure 2:
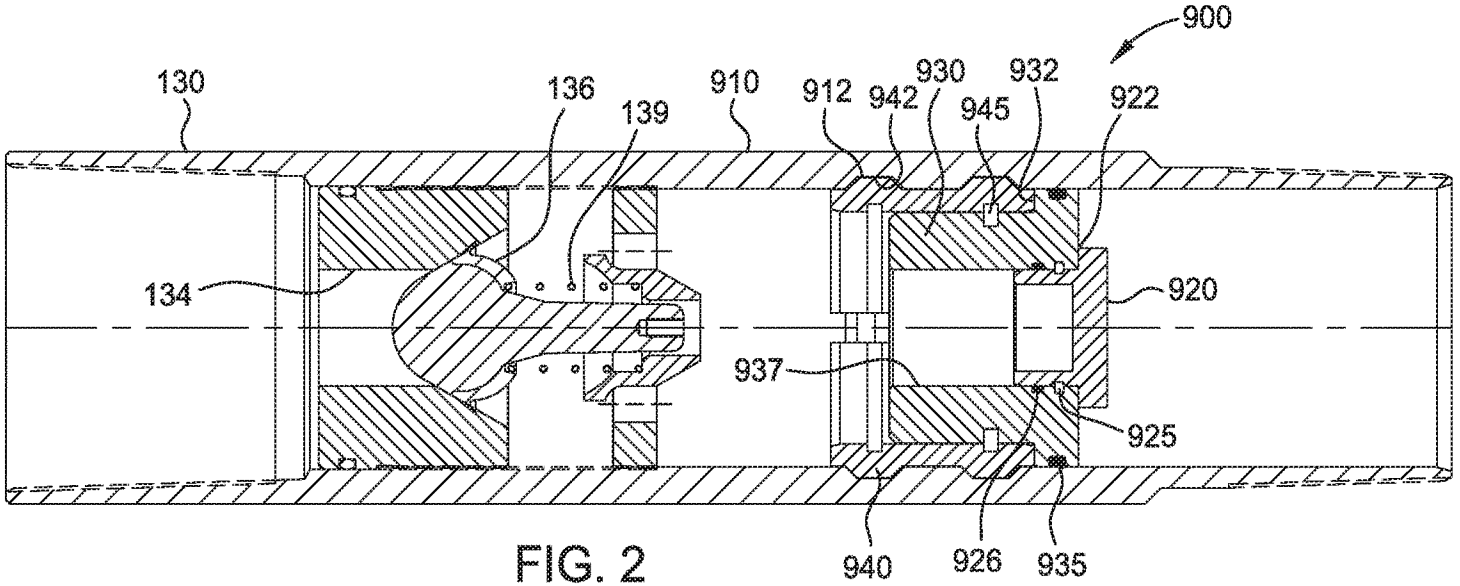
FIG. 2 illustrates an exemplary embodiment of a valve assembly of FIG. 1.

The distal end of the casing string 120 includes a shoe 124 attached to the distal end of the casing string 120. The shoe 124 may have a tapered exterior surface that can guide the distal end of the casing string 120 through the wellbore 104. The shoe 124 includes an aperture in fluid communication with the bore of the casing string 120. In various aspects, the shoe 124 can have multiple apertures therethrough. A valve assembly 130 arranged in the casing string 120 is spaced apart from the distal end of the casing string 120. The valve assembly 130 includes a passageway 134 in fluid communication with the bore of the casing string 120, as shown in FIG. 2. The ends of the valve assembly 130 are connectable to the casing string 120, such as via threads. A valve 136 can be arranged in the passageway to control fluid communication through the passageway 134. The valve 136 can include a biasing mechanism 139, such as a spring, that urges the valve 136 into a closed position. The passageway 134 and the valve 136 can be made of a composite material (e.g., a plastic material, a composite material, or a fiber reinforced composite material). A fluid, such as cement or drilling fluid can be pumped through the casing string 120 to overcome the biasing force of the biasing mechanism to move the valve to an open position;

Due to the weight of the casing string 120, the distal end of the casing string 120 is resting on a wall surface of the diverging section 108 and/or the horizontal section 110 of the wellbore 104 during the run-in. As the distal end of the casing string 120 is translating through the horizontal section 110 of the wellbore 104, friction between the casing string 120 and the bottom surface of the horizontal section 110 can make it difficult for the casing string 120 to reach its target location.

In various embodiments described herein, the casing string 120 is equipped with a buoyant system to reduce the weight of the casing string 120 resting on the bottom surface of the wellbore.

In one embodiment, the buoyant system includes a buoyant chamber 150 formed in the casing string 120 to facilitate positioning of the casing string 120 in the wellbore 104. The chamber 150 is formed between the valve assembly 130 in the closed position and a sealing device 200 positioned upstream from the valve assembly 130. As shown in FIG. 1, the sealing device 200 is positioned in a vertical section 106 of the casing string 120. However, it is contemplated the sealing device 200 may be positioned in the diverging section 108 or horizontal section 110. The sealing device 200 is configured to prevent fluid communication in the casing bore across the sealing device 200. The distance between the sealing device 200 and the valve assembly 130 can be selected based on the desired amount of buoyance.

Figure 3:
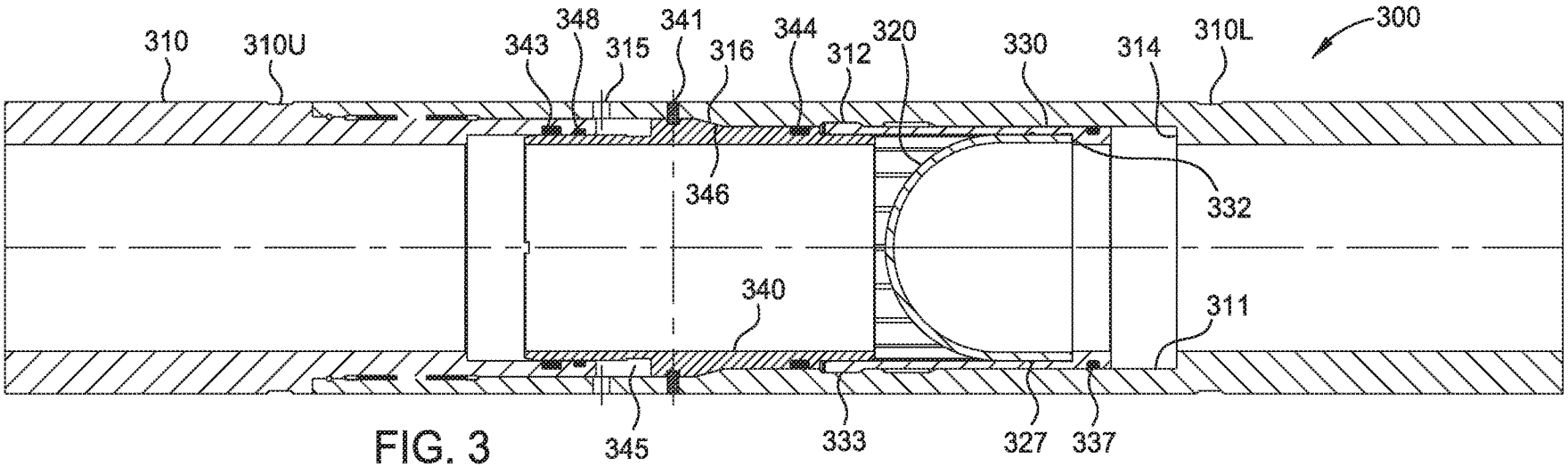
FIG. 3 illustrates an exemplary embodiment of a sealing device.

FIG. 3 illustrates an exemplary embodiment of a sealing device 300. The sealing device 300 is suitable for use as the sealing device 200 in FIG. 1. The sealing device 300 includes a tubular body 310, a frangible sealing element 320, a collet seat 330, and a sleeve 340. The tubular body 310 includes an upper body 310U connected to a lower body 310L. The collet seat 330 is disposed in a recessed portion 311 of the tubular body 310. The collet seat 330 includes a plurality of collet heads 333 disposed at an upper end. The collet heads 333 are engaged with a groove 312 formed in the recessed portion 311. A shoulder 332 is provided at a lower end of the interior surface of the collet seat 330. A sealing member 337 such as a seal ring is disposed between the collet seat 330 and the tubular body 310 to prevent fluid communication therebetween. A gap exists between the bottom of the collet seat 330 and the lower end 314 of the recessed portion 311. When the collet heads 333 are released from the groove 312, the collet seat 330 is movable to contact the lower end 314 of the recessed portion.

A releasable sleeve 340 is provided to retain the collet heads 333 in the groove 312. The sleeve 340 is releasably attached to the tubular body 310 using one or more shearable members 341 such as a shear pins. The lower end of the sleeve 340 is disposed on the interior side of the collet heads 333 to prevent the collet heads 333 from disengaging the groove 312. The upper end of the sleeve 340 has a smaller outer diameter portion that extends across the recessed portion of the tubular body 310. An annular chamber 345 is formed between the upper end of the sleeve 340 and the tubular body 310. An annulus port 315 allows fluid communication between the annular chamber 345 and the exterior of the tubular body 310. A smaller, upper seal ring 343 and a larger, lower seal ring 344 are positioned to prevent fluid communication between the annular chamber 345 and the bore of the tubular body 310. The outer surface of the sleeve 340 includes an optional tapered surface 346 in contact with a complementary tapered surface 316 of the tubular body 310. The tapered surfaces 316, 346 are configured to prevent the downward movement of the sleeve 340. The tapered surfaces 316, 346 also reduce the axial load on the shear pins 341. It must be noted any suitable number of shearable members may be used, for example, from one to twelve shear pins or from two to eight shear pins. The number of shear pins may depend on the desired release pressure for releasing the sleeve 340. In this example, the release pressure is independent of the hydrostatic pressure. Thus, the desired release pressure may be selected by choosing the appropriate number of shear pins. In another embodiment, the manufacturing material of the shear pins provides an additional option to select the release pressure. The material of the shear pins may be changed to increase or decrease the shear force of the pins. Suitable materials for the shear pins include steel, brass, alloys, plastic, and combinations thereof. A switch from brass to steel will increase shear force required to break a shear pin. In one example, the tubular body 310 is pre-drilled with holes for receiving the shear pins. Depending on the desired release pressure, the number of shear pins used may be the same or less than the number of pre-drilled holes. For example, if six holes are pre-formed in the tubular body 310, a shear pin may be disposed in each hole if maximum release pressure is desired.

The frangible sealing element 320 is disposed in the collet seat 330. In one embodiment, the sealing element 320 includes a semispherical dome. The bottom end of the sealing element 320 is supported by the shoulder 332 of the collet seat 330. As shown, the convex surface of the dome is oriented upward toward the rig, and the concave surface of the dome is oriented downward toward the shoe 124 and the valve assembly 130. The sealing element 320 sealingly engages the collet seat 330 to prevent fluid communication between the sealing element 320 and the collet seat 330. For example, a sealing member 327 such as a seal ring is disposed between the collet seat 330 and the sealing element 320 to prevent fluid communication therebetween. The sealing element 320 may be made of a frangible material such as ceramics, metals, glass, porcelains, carbides, and other suitable frangible materials. The convex side of the dome can withstand more pressure than the concave side. For example, the convex side can be rated to withstand a pressure range from 2,000 psi to 13,000 psi, a pressure range from 5,000 psi to 11,500 psi, or a pressure range from 8,000 to 11,000 psi. The concave side can be rated to withstand a pressure range from 300 psi to 5,000 psi, a pressure range from 500 psi to 3,000 psi, or a pressure range from 900 to 1,300 psi. In another example, the sealing element 320 can be configured to withstand a pressure difference from 500 psi to 11,000 psi between the convex side and concave side. In another embodiment, sealing element can withstand a range of ratio of the pressure on the convex side to the pressure on the concave side from 3:1 to 15:1, from 5:1 to 12:1, and from 9:1 to 11:1.

The buoyance chamber 150 may be filled with air instead of liquid to reduce the weight of the casing string 120 in the wellbore 104. In some embodiments, the casing string 120 can be filled with a mixture of air and liquid. In some embodiments, the casing string 120 is filled with a fluid having a lower specific gravity than the fluid in the wellbore 104. Other suitable fluids for filling the casing string 104 include gases such as nitrogen, carbon dioxide, and a noble gas.

In operation, the casing string 120 is run into the wellbore 104 equipped with a buoyant system having a buoyant chamber 150 formed between a valve assembly 130 and a sealing device 300. The buoyant chamber 150 is filled with air to increase the buoyancy effect on the casing string 120, thereby reducing the friction between the casing string 120 and the wall of the wellbore 104. The reduced friction facilitates the run-in of the casing string 120.

Figure 4:
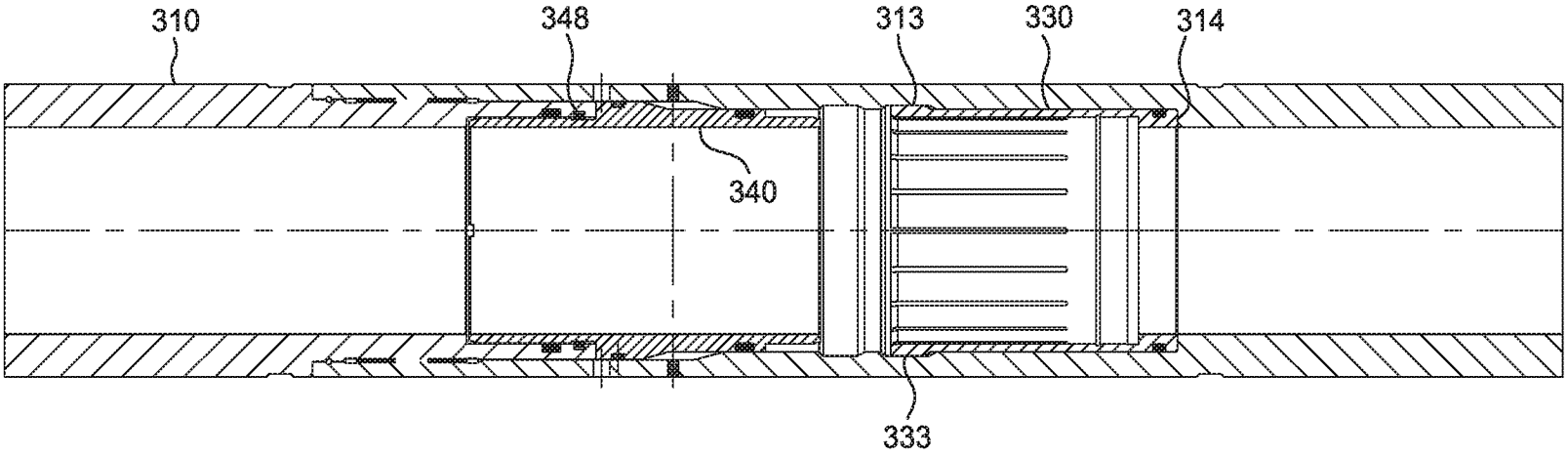
FIG. 4 shows the sealing device of FIG. 3 after the sealing element has been shattered.

After reaching the desired location, pressure above the dome of the sealing element 320 is increased to urge the sleeve 340 to move upward. When sufficient pressure is applied to break the shearable pins 341, the sleeve 340 is moved upward relative to the collet seat 330. It is noted that during run-in, the pressure in the bore of the casing string 120 is approximately the same as the external pressure. Thus, the amount of increased pressure above the dome should be about the same as the differential pressure required for shearing the pins 341. In other words, in this example, the pressure applied to shear the pins 341 is independent of the hydrostatic pressure. After the pins 341 shears, the lower end of the sleeve 340 is moved away from the collet heads 333, thereby freeing the collet heads 333 to disengage from the groove 312. In turn, the collet seat 330 is moved downward, away from the sleeve 340, toward the lower end 314 of the recessed portion 311. The sealing element 320, attached to the collet seat 330, moves downward with the collet seat 330 until the collet seat 320 contacts the lower end 314. The contact force and the pressure above the dome cause the frangible sealing element 320 to break, thereby opening the buoyant chamber 150 for fluid communication. FIG. 4 illustrates the sealing device 300 after the sealing element 320 has been broken. The sleeve 340 has moved upward and may be optionally retained in position using a lock ring 348. The heads 333 of the collet seat 330 are engaged with a lower groove 313. The collet seat 330 has moved downward and rests against the lower end of the tubular body 310. A circulating fluid such as a drilling fluid may fill the buoyant chamber and exit out the shoe 124. Thereafter, a cementing operation is performed to supply cement into the annular area between the casing string 120 and the wellbore 104.

Figure 5:
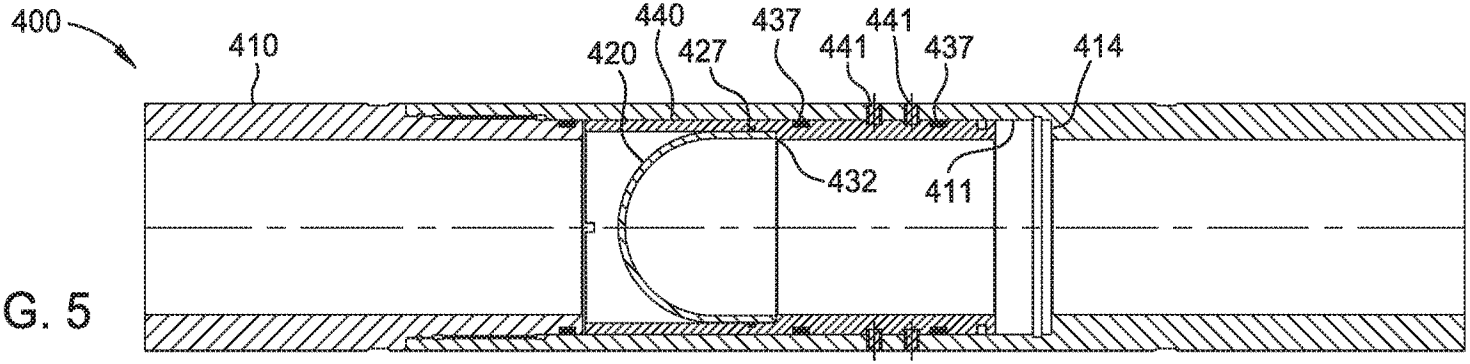
FIG. 5 illustrates another exemplary embodiment of a sealing device.

FIG. 5 illustrates another exemplary embodiment of a sealing device 400. The sealing device 400 is suitable for use as the sealing device 200 in FIG. 1. The sealing device 400 includes a tubular body 410, a frangible sealing element 420, and a movable sleeve 440. The tubular body 410 includes an upper body connected to a lower body. The movable sleeve 440 is disposed in a recessed portion 411 of the tubular body 410.

The movable sleeve 440 is releasably attached to the tubular body 410 using one or more shearable members 441 such as shearable pins. In this embodiment, two rows of shearable pins 441 circumferentially spaced around the sleeve 440 are used to releasably attach the sleeve 440 to the tubular body 410. A gap exists between the bottom of the movable sleeve 440 and the lower end 414 of the recessed portion 411. When the movable sleeve 440 is released from the shear pins 441, the movable sleeve 440 is movable to contact the lower end 414 of the recessed portion 411. A seal ring 437 is disposed on each side of the shear pins 441 to prevent fluid communication between the sleeve 440 and the tubular body 410.

The frangible sealing element 420 is disposed in the movable sleeve 440. In one embodiment, the sealing element 420 includes a semispherical dome. The bottom end of the sealing element 420 is supported by the shoulder 432 of the movable sleeve 440. As shown, the convex surface of the dome is oriented upward toward the rig, and the concave surface of the dome is oriented downward toward the shoe 124. The sealing element 420 sealingly engages the movable sleeve 440 to prevent fluid communication between the sealing element 420 and the movable sleeve 440. For example, a sealing member 437 such as a seal ring is disposed between the movable sleeve 440 and the sealing element 420 to prevent fluid communication therebetween. The sealing element 420 may be made of a frangible material such as ceramics, metals, glass, porcelains, carbides, and other suitable frangible materials. The sealing element 420 may have the same pressure ratings as described above with respect to sealing element 320.

In operation, the casing string 120 is run into the wellbore 104 equipped with a buoyant system having a buoyant chamber 150 formed between a valve assembly 130 and a sealing device 400. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 420 is increased to urge the sleeve 440 to move downward. When sufficient pressure is applied to break the shearable pins 441, the sleeve 440 is moved downward relative to the tubular body 410. After the pins 441 shears, the lower end of the sleeve 440 moves downward toward the lower end 414 of the recessed portion 411. The sealing element 420, attached to the sleeve 440, moves downward with the sleeve 440 until the sleeve 440 contacts the lower end 414. The contact force and the pressure above dome cause the frangible sealing element 420 to break, thereby opening the buoyant chamber 150 for fluid communication. A circulating fluid such as a drilling fluid may fill the buoyant chamber and exit out the shoe 124.

Thereafter, a cementing operation is performed to supply cement into the annular area between the casing string 120 and the wellbore 104.

Figure 6:
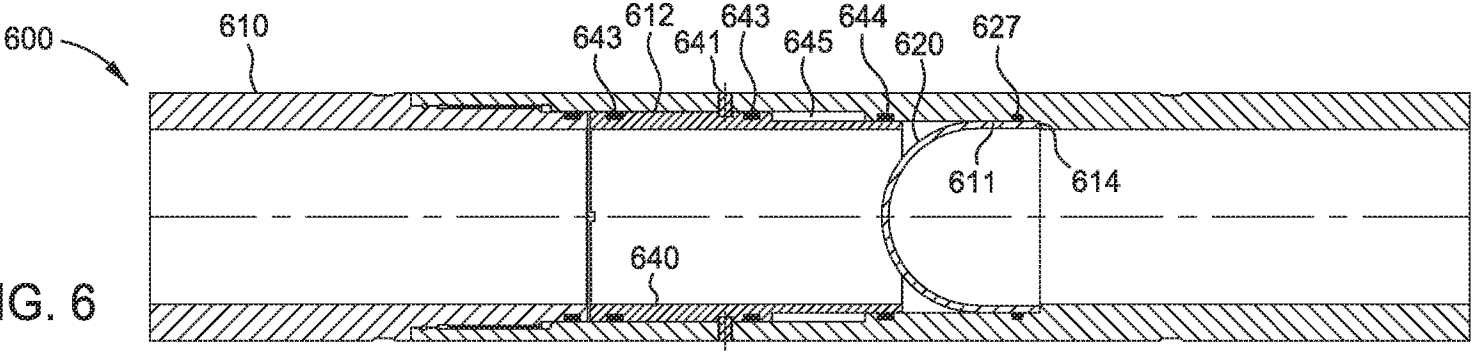
FIG. 6 illustrates another exemplary embodiment of a sealing device.

FIG. 6 illustrates an exemplary embodiment of a sealing device 600. The sealing device 600 is suitable for use as the sealing device 200 in FIG. 1. The sealing device 600 includes a tubular body 610, a frangible sealing element 620, and a sleeve 640. The tubular body 610 includes an upper body connected to a lower body.

The frangible sealing element 620 is disposed in a first recessed portion 611 of the tubular body 610. In one embodiment, the sealing element 620 includes a semispherical dome. The bottom end of the sealing element 620 is supported by the lower end 614 of the recessed portion 611. As shown, the convex surface of the dome is oriented upward toward the rig, and the concave surface of the dome is oriented downward toward the shoe 124. The sealing element 620 sealingly engages the tubular body 610 to prevent fluid communication between the sealing element 620 and the tubular body 610. For example, a sealing member 627 such as a seal ring is disposed between the tubular body 610 and the sealing element 620 to prevent fluid communication therebetween. The sealing element 620 may be made of a frangible material such as ceramics, metals, glass, porcelains, carbides, and other suitable frangible materials. The sealing element 620 may have the same pressure ratings as described above with respect to sealing element 320.

A releasable sleeve 640 is provided to break the sealing element 620. The sleeve 640 is releasably attached to the tubular body 610 using a shearable member 641 such as a shear pin. The sleeve 640 is at least partially disposed in the first recessed portion 611 and a second recessed portion 612 of the tubular body 610. The upper end of the sleeve 640 is in contact with the second recessed portion 612. The lower end of the sleeve 640 has a smaller outer diameter portion that extends across the first recessed portion 611 of the tubular body 610. An annular chamber 645 is formed between the smaller outer diameter portion and the second recessed portion 612. Two larger, upper seal rings 643 and a smaller, lower seal ring 644 are positioned to prevent fluid communication between the annular chamber 645 and the bore of the tubular body 610. The shearable member 641 is disposed between the two upper seal rings 643. The annular chamber 645 is filled with a compressible fluid such as air. A gap exists between the bottom of the sleeve 640 and the sealing element 620. When the sleeve 640 is released from the pins, the sleeve 640 is movable into contact with the sealing element 620.

In operation, the casing string 120 is run into the wellbore 104 equipped with a buoyant system having a buoyant chamber 150 formed between a valve assembly 130 and a sealing device 600. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 620 is increased to urge the sleeve 640 to move downward. When sufficient pressure is applied to break the shearable pins 641, the sleeve 640 is moved downward relative to the sealing element 620. After the pins 641 shear, the lower end of the sleeve 640 is moved into contact with the sealing element 620. The contact force and the pressure above dome cause the frangible sealing element 620 to break, thereby opening the buoyant chamber 150 for fluid communication. A circulating fluid such as a drilling fluid may fill the buoyant chamber and exit out the shoe 124. Thereafter, a cementing operation is performed to supply cement into the annular area between the casing string 120 and the wellbore 104.

Figure 7:
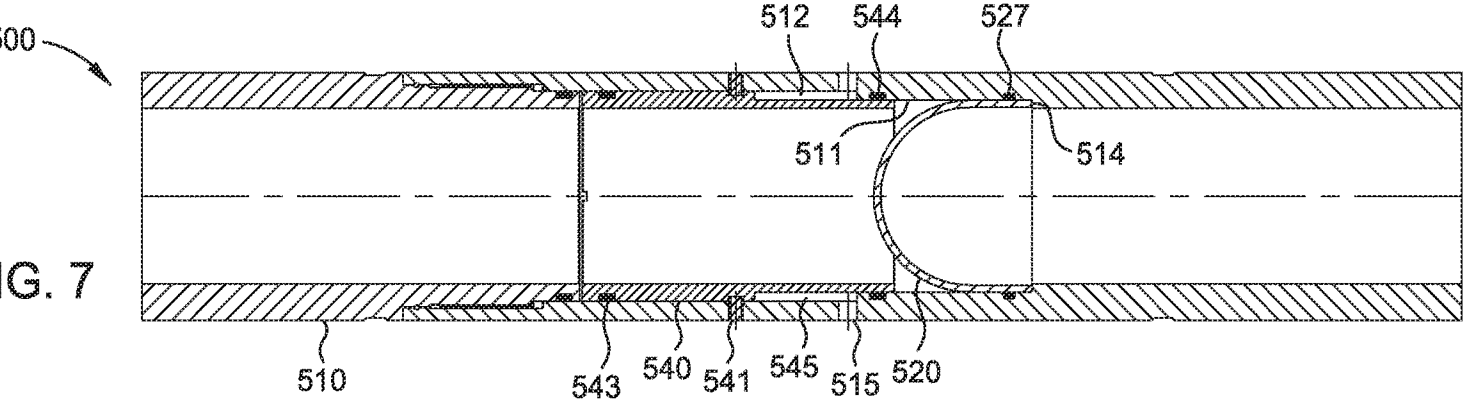
FIG. 7 illustrates another exemplary embodiment of a sealing device.

FIG. 7 illustrates an exemplary embodiment of a sealing device 500. The sealing device 500 is suitable for use as the sealing device 200 in FIG. 1. The sealing device 500 includes a tubular body 510, a frangible sealing element 520, and a sleeve 540. The tubular body 510 includes an upper body connected to a lower body.

The frangible sealing element 520 is disposed in a first recessed portion 511 of the tubular body 510. In one embodiment, the sealing element 520 includes a semispherical dome. The bottom end of the sealing element 520 is supported by the lower end 514 of the recessed portion 511. As shown, the convex surface of the dome is oriented upward toward the rig, and the concave surface of the dome is oriented downward toward the shoe 124. The sealing element 520 sealingly engages the tubular body 510 to prevent fluid communication between the sealing element 520 and the tubular body 510. For example, a sealing member 527 such as a seal ring is disposed between the tubular body 510 and the sealing element 520 to prevent fluid communication therebetween. The sealing element 520 may be made of a frangible material such as ceramics, metals, glass, porcelains, carbides, and other suitable frangible materials. The sealing element 520 may have the same pressure ratings as described above with respect to sealing element 320.

A releasable sleeve 540 is provided to break the sealing element 520. The sleeve 540 is releasably attached to the tubular body 510 using a shearable member 541 such as a shear pin. The sleeve 540 is at least partially disposed in the first recessed portion 511 and a second recessed portion 512 of the tubular body 510. The upper end of the sleeve 540 is in contact with the second recessed portion 512. The lower end of the sleeve 540 has a smaller outer diameter portion that extends across the first recessed portion 511 of the tubular body 510. An annular chamber 545 is formed between the smaller outer diameter portion and the second recessed portion 512. An annulus port 515 allows fluid communication between the annular chamber 545 and the exterior of the tubular body 510. A larger, upper seal ring 543 and a smaller, lower seal ring 544 are positioned to prevent fluid communication between the annular chamber 545 and the bore of the tubular body 510. A gap exists between the bottom of the sleeve 540 and the sealing element 520. When the sleeve 540 is released from the pins, the sleeve 540 is movable into contact with the sealing element 520.

In operation, the casing string 120 is run into the wellbore 104 equipped with a buoyant system having a buoyant chamber 150 formed between a valve assembly 130 and a sealing device 500. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 520 is increased to urge the sleeve 540 to move downward. When sufficient pressure is applied to break the shearable pin 541, the sleeve 540 is moved downward relative to the sealing element 520. After the pins 541 shear, the lower end of the sleeve 540 is moved into contact with the sealing element 520. The contact force and the pressure above dome cause the frangible sealing element 520 to break, thereby opening the buoyant chamber 150 for fluid communication. A circulating fluid such as a drilling fluid may fill the buoyant chamber and exit out the shoe 124. Thereafter, a cementing operation is performed to supply cement into the annular area between the casing string 120 and the wellbore 104.

Figure 8:
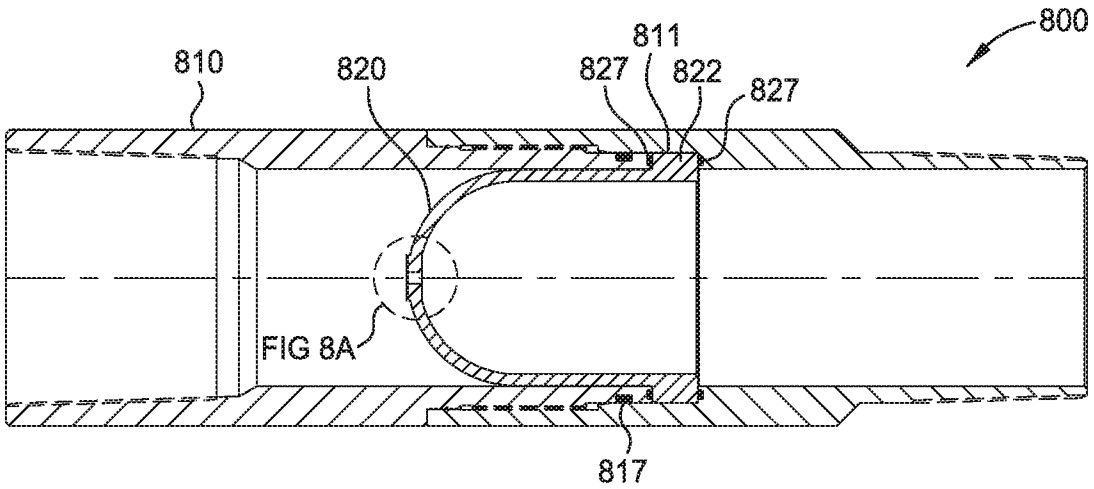
FIG. 8 illustrates another exemplary embodiment of a sealing device.

FIG. 8 illustrates an exemplary embodiment of a sealing device 800. The sealing device 800 is suitable for use as the sealing device 200 in FIG. 1. The sealing device 800 includes a tubular body 810 and a frangible sealing element 820. The tubular body 810 includes an upper body connected to a lower body. A sealing member 817, such as a seal ring, is disposed between the upper body and the lower body to prevent fluid communication therebetween.

The frangible sealing element 820 is disposed in the tubular body 810. In one embodiment, the sealing element 820 includes a semispherical dome. The lower end of the sealing element 820 includes a shoulder 822 that is disposed in a recessed portion 811 of the tubular body 810. As shown, the convex surface of the dome is oriented upward toward the rig, and the concave surface of the dome is oriented downward toward the shoe 124. The sealing element 820 sealingly engages the tubular body 810 to prevent fluid communication between the sealing element 820 and the tubular body 810. For example, sealing members 827 such as a seal ring is disposed between the tubular body 810 and the shoulder of the sealing element 820 to prevent fluid communication therebetween. The sealing element 820 may be made of a frangible material such as ceramics, metals, glass, porcelains, carbides, and other suitable frangible materials. The sealing element 820 may have the same pressure ratings as described above with respect to sealing element 320.

Figure 8C:
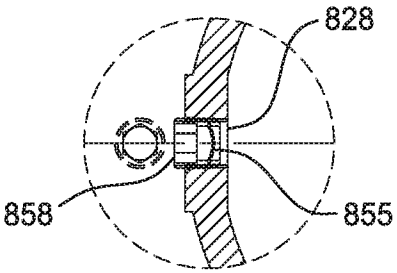

In one embodiment, the sealing element 820 includes an aperture 828. The aperture 828 is selectively blocked from fluid communication using a rupture device. In the embodiment shown in FIG. 8A, the rupture device is a cover 838 made of a rupturable material. For example, the cover 838 can be a foil made of a material such as titanium, composite material, plastic, and other suitable rupturable material. The cover 838 can be configured to rupture at a selected pressure differential. In one example, the cover 838 is a foil made of titanium having a thickness from 0.01 inches to 0.2 inches and from 0.02 inches to 0.06 inches. The thickness of the cover 838 may depend on the size of the aperture and the selected pressure differential. For example, a thinner cover 838 can be used for a smaller diameter aperture to achieve the same rupture pressure differential. The aperture can have a diameter from 0.1 inches to 0.8 inches; from 0.15 inches to 0.5 inches; and from 0.2 inches to 0.3 inches. In one example, the aperture is 0.25 inches.

Figure 8B:
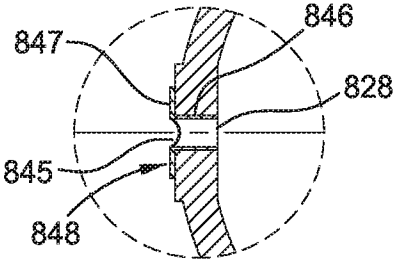
Figure 8A:
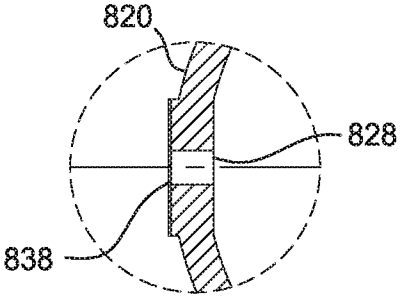

FIG. 8B illustrates another exemplary rupture device. In this example, the rupture device is an insert 848 having a rupture disk 845. The insert 848 has a tubular body 846 that can line at least a portion of the wall of the aperture 828. The insert 848 can a have a flange 847 that rests against the top surface of the dome. The rupture disk 845 can be configured to rupture at a selected pressure differential.

FIG. 8C illustrates another exemplary rupture device. In this example, the rupture device 858 includes a rupture disk 855 attached to a body having exterior threads that mates with threads in the aperture 828. The rupture disk 855 can be configured to rupture at a selected pressure differential.

In operation, the casing string 120 is run into the wellbore 104 equipped with a buoyant system having a buoyant chamber 150 formed between a valve assembly 130 and a sealing device 800. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 820 is increased to break the cover 838 over the aperture 828. The cover 838 ruptures when sufficient pressure is applied, thereby opening the aperture 828 for fluid communication. Without being bound by theory, it is believed fluid rushing through the aperture 828 causes cavitation that, in turn, causes the sealing element 820 to shatter. In this manner, the buoyant chamber 150 in the casing string 120 is opened for fluid communication. A circulating fluid such as a drilling fluid may fill the buoyant chamber and exit out the shoe 124. Thereafter, a cementing operation is performed to supply cement into the annular area between the casing string 120 and the wellbore 104.

In another embodiment, a sealing device 900 is disposed at a lower end of the casing string 120, as shown in FIGS. 1 and 2. FIG. 2 is an enlarged partial view of FIG. 1. The sealing device 900 is positioned between the valve assembly 130 and the shoe 124. The sealing device 900 prevents fluid in the wellbore from filling the bore of the casing string 120. The sealing device 900 is configured to withstand the high pressure environment (e.g., 10,000 psi) in the wellbore and protects the valve assembly 130 from the high pressure environment.

Referring to FIG. 2, the sealing device in 900 includes a tubular body 910, a plug housing 930, a plurality of arcuate segments 940, and a releasable plug 920. The arcuate segments 940 have dogs 942 formed on an exterior surface that mate with grooves 912 formed in the tubular body 910. In this embodiment, two arcuate segments 940 are used to connect the plug housing 930 to the tubular body 910. The plug housing 930 is disposed in the arcuate segments 940 and prevents the arcuate segments 940 from disengagement with the tubular body 910. A shearable connector 945 such as a snap ring is used to releasably attach the plug housing 930 to the arcuate segments 940. The plug housing 930 includes a shoulder 932 in contact with the tubular body 910. A seal ring 935 is disposed between the shoulder 932 and the tubular body 910 to prevent fluid communication therebetween.

Figure 9:
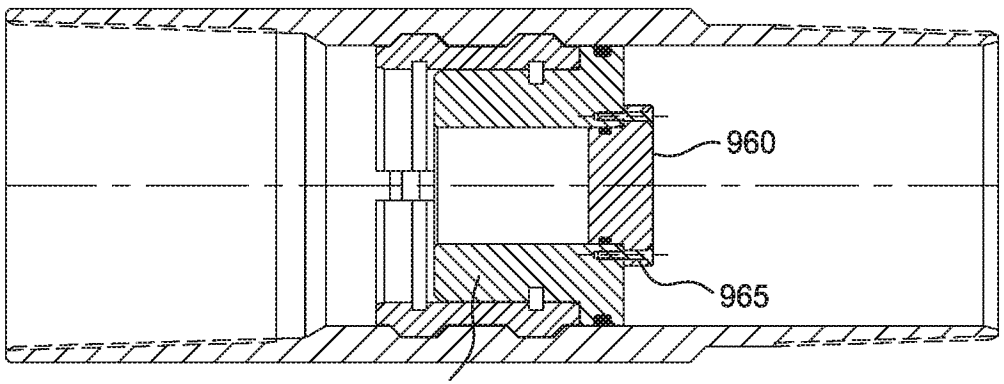
FIG. 9 illustrates another exemplary embodiment of a lower sealing device.

The releasable plug 920 is at least partially disposed in a bore 937 of the plug housing 930. A shearable connector 925 such as a snap ring is used to releasably attach the plug 920 to the plug housing 930. In another embodiment, shear pins 965 are used to releasably attach the plug 960 to the plug housing 930, as shown in FIG. 9. A seal ring 926 is disposed between the plug 920 and the plug housing 930 to prevent fluid communication therebetween. The plug 920 includes a shoulder 922 abutted against the bottom end of the plug housing 930. The shoulder 922 allows the plug 920 to withstand a pressure higher than the shearable connector 925 alone. Thus, a higher pressure is needed to release the plug 920 in the uphole direction than in the downhole direction.

In operation, the casing string 120 is run into the wellbore 104 equipped with a buoyant system having a buoyant chamber 150 formed between a valve assembly 130 and an upper sealing device 300. The casing string 120 includes a lower sealing device 900 disposed between the valve assembly 130 and the shoe 124. The lower sealing device 900 may act as a redundant sealing mechanism for the buoyant chamber 150. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 320 is increased to shatter the sealing element 320, as previously discussed with respect to FIGS. 3 and 4. After breaking the sealing element 320, fluid is supplied to fill the buoyant chamber 150 and circulate out most of the air. Thereafter, pressure in the casing string 120 is increased until it is sufficient to shear the shearable connection 925 retaining the plug 920. After the plug 920 is released, a fluid such as a drilling fluid may be circulated out of the shoe 124. Thereafter, a cementing operation is performed to supply cement into the annular area between the casing string 120 and the wellbore 104.

Figure 10:
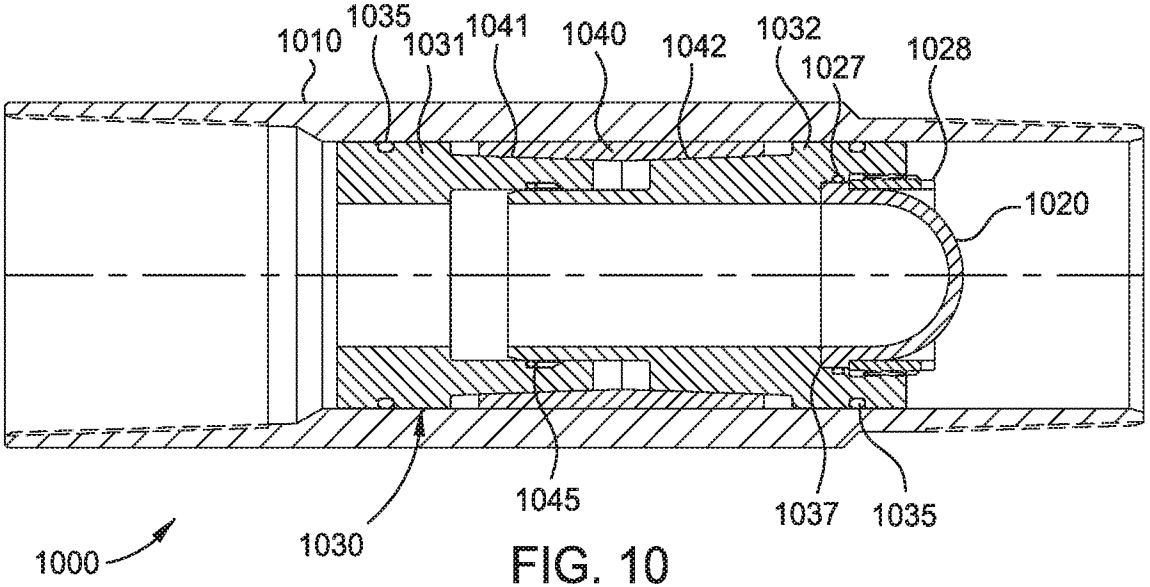
FIG. 10 illustrates another exemplary embodiment of a lower sealing device.
Figure 10A:
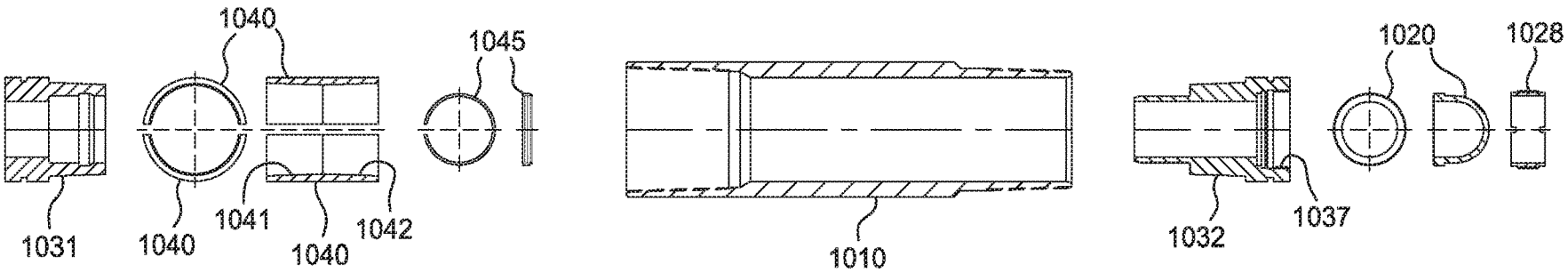
FIG. 10A illustrates the components of the sealing device of FIG. 10.

Another exemplary embodiment of a lower sealing device 1000 is shown in FIGS. 10 and 10A. FIG. 10A is a view of the components of the sealing device 1000. The lower sealing device 1000 is suitable for use as the sealing device 900 of FIG. 1 and can be positioned between the valve assembly 130 and the shoe 124. The sealing device 1000 prevents fluid in the wellbore from filling the bore of the casing string 120. The sealing device 1000 is configured to withstand the high pressure environment (e.g., 10,000 psi) in the wellbore and protects the valve assembly 130 from the high pressure environment.

Referring to FIGS. 10 and 10A, the sealing device in 1000 includes a tubular body 1010, a seal housing 1030, a plurality of arcuate segments 1040, and a sealing element 1020. The seal housing 1030 includes a first housing body 1031 connected to a second housing body 1032. The upper end of the second housing body 1032 is insertable into a bore in the lower end of the first housing body 1031. A shearable connection 1045 such as a snap ring is used to connect the first and second housing bodies 1031, 1032. A seal ring 1035 is disposed between each of the housing bodies 1031, 1032 and the tubular body 1010. The arcuate segments 1040 are disposed in an annular area between the tubular body 1010 and the housing bodies 1031, 1032. In this example, two semicircular arcuate segments 1040 are positioned in the annular area. The upper portion of the inner surface of the arcuate segments 1040 have an inward incline 1041 that mates with a complementary incline of the first housing body 1031, and the lower portion of the inner surface of the arcuate segments 1040 have an outward incline 1042 that mates with a complementary incline of the second housing body 1032. The inward incline 1041 restricts movement of the first housing body 1031 toward the second housing body 1032, and the outward incline 1042 restricts movement of the second housing body 1032 toward the first housing body 1031.

The sealing element 1020 is at least partially disposed in a bore 1037 of the second housing body 1032. In one embodiment, the sealing element 1020 includes a semi-spherical dome. As shown, the concave surface of the dome is oriented upward toward the rig, and the convex surface of the dome is oriented downward toward the shoe 124. The sealing element 1020 sealingly engages the second housing body 1032 to prevent fluid communication between the sealing element 1020 and the housing body 1032. For example, a sealing member 1027 such as a seal ring is disposed between the housing body 1032 and the sealing element 1020 to prevent fluid communication therebetween. The sealing element 1020 is made of a frangible material such as ceramics, metals, glass, porcelains, carbides, and other suitable frangible materials. The sealing element 1020 may have the same pressure ratings as described above with respect to sealing element 320. A retainer sleeve 1028 disposed around the sealing element 1020 is used to retain the sealing element 1020 against the housing body 1032. The retainer sleeve 1028 threadedly connects to the second housing body 1032.

In operation, the casing string 120 is run into the wellbore 104 equipped with a buoyant system having a buoyant chamber 150 formed between a valve assembly 130 and an upper sealing device 300. The casing string 120 includes a lower sealing device 1000 disposed between the valve assembly 130 and the shoe 124. The lower sealing device 1000 may act as a redundant sealing mechanism for the buoyant chamber 150. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 320 is increased to shatter the sealing element 320, as previously discussed with respect to FIGS. 3 and 4. After breaking the sealing element 320, fluid is supplied to fill the buoyant chamber 150 and circulate out most of the air. Thereafter, pressure in the casing string 120 is increased until it is sufficient to shatter the sealing element 1020. After breaking the sealing element 1020, a fluid such as a drilling fluid may be circulated out of the shoe 124. Thereafter, a cementing operation is performed to supply cement into the annular area between the casing string 120 and the wellbore 104.

Figure 11:
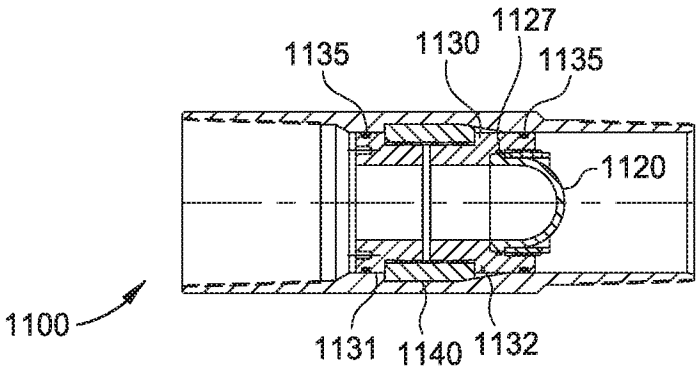
FIG. 11 illustrates another exemplary embodiment of a lower sealing device.
Figure 11A:
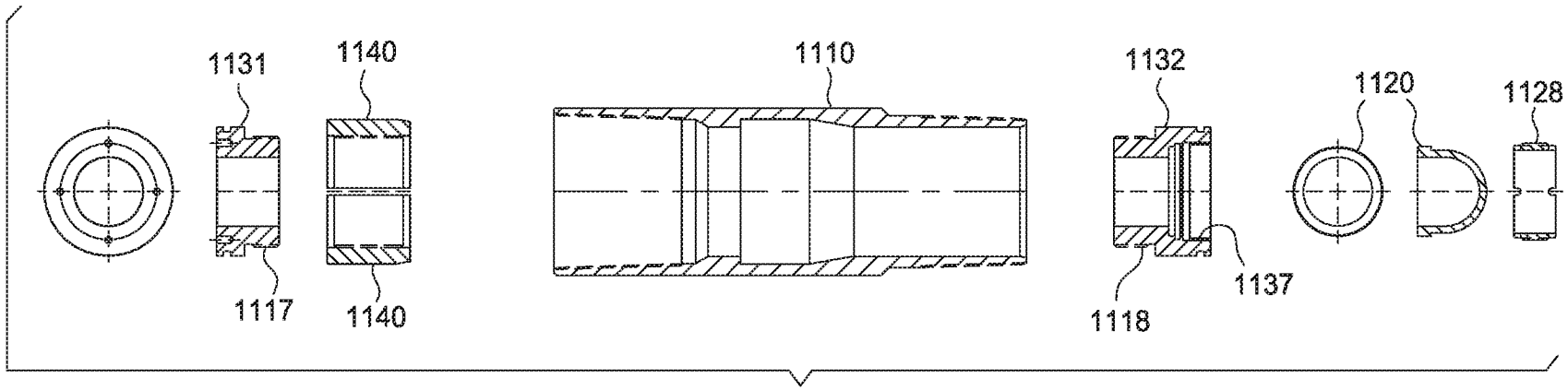
FIG. 11A illustrates the components of the sealing device of FIG. 11.

Another exemplary embodiment of a lower sealing device 1100 is shown in FIGS. 11 and 11A. FIG. 11A is a view of the components of the sealing device 1100. The lower sealing device 1100 is suitable for use as the sealing device 900 of FIG. 1 and can be positioned between the valve assembly 130 and the shoe 124. The sealing device 1100 prevents fluid in the wellbore from filling the bore of the casing string 120. The sealing device 1100 is configured to withstand the high pressure environment (e.g., 10,000 psi) in the wellbore and protects the valve assembly 130 from the high pressure environment.

Referring to FIGS. 11 and 11A, the sealing device in 1100 includes a tubular body 1110, a seal housing 1130, a plurality of arcuate segments 1140, and a sealing element 1120. The seal housing 1130 includes a first housing body 1131 and a second housing body 1132. A seal ring 1135 is disposed between each of the housing bodies 1131, 1132 and the tubular body 1110. The arcuate segments 1140 are disposed in an annular area between the tubular body 1110 and the housing bodies 1131, 1132. In this example, two semicircular arcuate segments 1140 are positioned in the annular area. The annular area may be formed by a recess in the tubular body 1110 and a recess in the housing bodies 1131, 1132. The recess of housing bodies 1131, 1132 includes threads 1117, 1118, respectively, for mating with threads on the arcuate segments 1140.

The sealing element 1120 is at least partially disposed in a bore 1137 of the second housing body 1132. In one embodiment, the sealing element 1120 includes a semi-spherical dome. As shown, the concave surface of the dome is oriented upward toward the rig, and the convex surface of the dome is oriented downward toward the shoe 124. The sealing element 1120 sealingly engages the second housing body 1132 to prevent fluid communication between the sealing element 1120 and the housing body 1132. For example, a sealing member 1127 such as a seal ring is disposed between the housing body 1132 and the sealing element 1120 to prevent fluid communication therebetween. The sealing element 1120 is made of a frangible material such as ceramics, metals, glass, porcelains, carbides, and other suitable frangible materials. The sealing element 1120 may have the same pressure ratings as described above with respect to sealing element 320. A retainer sleeve 1128 disposed around the sealing element 1120 is used to retain the sealing element 1120 against the housing body 1132. The retainer sleeve 1028 threadedly connects to the second housing body 1132.

In operation, the casing string 120 is run into the wellbore 104 equipped with a buoyant system having a buoyant chamber 150 formed between a valve assembly 130 and an upper sealing device 300. The casing string 120 includes a lower sealing device 1100 disposed between the valve assembly 130 and the shoe 124. The lower sealing device 1100 may act as a redundant sealing mechanism for the buoyant chamber 150. The buoyant chamber 150 is filled with air to increase the buoyancy effect on the casing string 120, thereby reducing the friction between the casing string 120 and the wall of the wellbore 104. The reduced friction facilitates the run-in of the casing string 120.

After reaching the desired location, pressure above the dome of the sealing element 320 is increased to shatter the sealing element 320, as previously discussed with respect to FIGS. 3 and 4. After breaking the sealing element 320, fluid is supplied to fill the buoyant chamber 150 and circulate out most of the air. Thereafter, pressure in the casing string 120 is increased until it is sufficient to shatter the sealing element 1120. Thereafter, a fluid such as a drilling fluid may be circulated out of the shoe 124. Thereafter, a cementing operation is performed to supply cement into the annular area between the casing string 120 and the wellbore 104.

Figure 12:
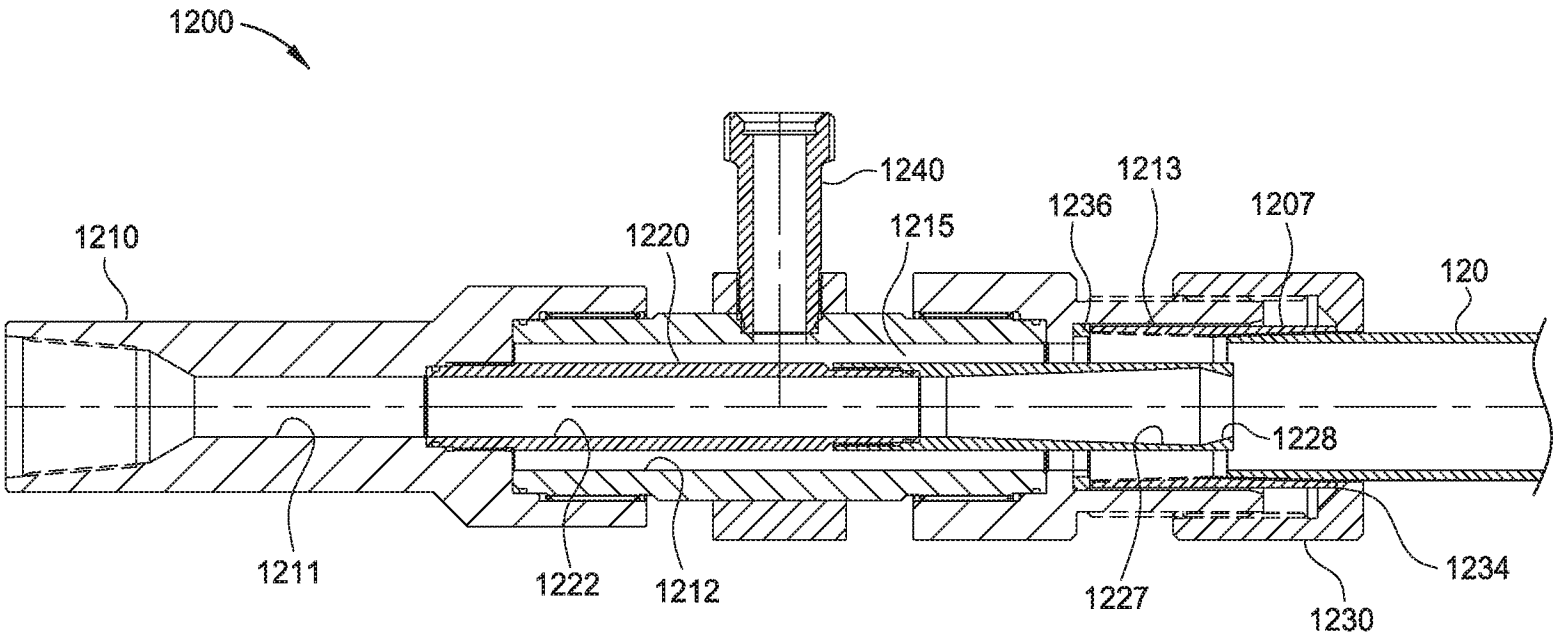
FIG. 12 illustrates an exemplary embodiment of circulation tool.

FIG. 12 illustrates an exemplary embodiment of a circulation tool 1200. The circulation tool 1200 may be used to supply fluid into the buoyant chamber 150 of the casing string 120 and circulate air out of the buoyant chamber 150. The circulation tool 1200 includes a tubular body 1210, an injector tube 1220, a latch 1230, and an air outlet 1240. The tubular body includes a first bore 1201 in fluid communication with a second bore 1212 and a third bore 1213. The second bore 1212 has a larger diameter than the first bore 1211. The third bore 1213 is sufficiently sized to receive an upper end of the casing string 120.

The injector tube 1220 is disposed inside the tubular body 1210 and includes a bore 1220 in fluid communication with the first bore 1211 of the tubular body 1210. An annular area 1215 is formed between the exterior of the injector tube 1220 and the section of the tubular body 1210 containing the second bore 1212 and the third bore 1213. The lower end of the bore 1222 of the injector tube 1220 is configured to choke the fluid flow out of the injector tube 1220. In one embodiment, the bore 1222 initially tapers outward before tapering inward just before the end of the injector tube 1220. In one example, angle of the outward taper 1227 is less than the angle of the inward taper 1228. For example, the outward taper 1227 may be between 1 degree to 10 degrees or between 1 degree and 5 degrees, such as 2 degrees. The inward taper 1228 is between 10 degrees and 20 degrees or between 13 degrees and 17 degrees, such as 15 degrees.

The air outlet 1240 is attached to the tubular body 1210 and is in fluid communication with the annular area 1215. The latch 1230 includes a shoulder 1234 for supporting a bottom end of the coupling 1207 at the upper end of the casing string 120. The latch 1230 may be spring actuated between an engaged position supporting the coupling 1207 and a disengaged position. An optional face seal 1236 is positioned between the upper end of the coupling 1207 and the tubular body 1210. The face seal 1236 may prevent leakage out of the circulation tool 1200.

In operation, the coupling 1207 is inserted into the circulation tool 1200, and the injection tube 1220 is positioned inside the casing string 120. The latch 1230 is actuated to engage and support the coupling 1207. After breaking the sealing element 320, the injector tube 1220 supplies fluid to fill the buoyant chamber 150. Air is circulated out of the casing string 120 and into the annular area 1215 of the circulation tool 1200. The air can exit the circulation tool 1200 via the air outlet 1240. Thereafter, a cementing operation is performed to supply cement into the annular area between the casing string 120 and the wellbore 104.

In one embodiment, a sealing device includes a tubular body having a bore; a collet seat having a plurality of collets; a frangible sealing element disposed in the collet seat and blocking fluid communication through the bore; and a releasable sleeve releasably attached to the tubular body and retaining the collet seat against the tubular body.

In one or more embodiments described herein, the collet seat is in a first position when retained by the sleeve, and wherein the collet seat is movable to a second position when released from the sleeve.

In one or more embodiments described herein, the sealing element breaks with the collet seat reaches the second position.

In one or more embodiments described herein, the collet seat contacts a shoulder in the tubular body when the collet seat reaches the second position.

In one or more embodiments described herein, the second position of the sleeve is located higher than the first position relative to the groove.

In one or more embodiments described herein, an annular chamber is formed between the sleeve and the tubular body.

In one or more embodiments described herein, the device includes a port for fluid communication between the annular chamber and an exterior of the tubular body.

In one or more embodiments described herein, the sealing element includes a frangible material selected from the group consisting of ceramics, metals, glass, porcelains, carbides, and combinations thereof.

In one or more embodiments described herein, each collet includes a collet head engaged with a groove formed in the tubular body.

In one or more embodiments described herein, the releasable sleeve, in a first position, prevents the collet head from disengaging from the groove, and, in a second position, allows the collet head from disengaging from the groove.

In one or more embodiments described herein, the sealing element comprises a dome.

In another embodiment, a sealing device includes a tubular body having a bore; a frangible sealing element disposed in the tubular body and blocking fluid communication through the bore; an aperture formed in the sealing element; and a rupture device selectively blocking fluid communication through the aperture.

In one or more embodiments described herein, the rupture device includes a foil cover.

In one or more embodiments described herein, the rupture device includes an insert having a rupture disk or a threaded body having a rupture disk.

In one or more embodiments described herein, the sealing element shatters in response to fluid flowing through the aperture.

In another embodiment, a tubular assembly disposed in a wellbore, includes a tubular string having a bore; a sealing device as described herein disposed in the tubular string and blocking fluid flow through the bore; a valve assembly disposed in the tubular string and downstream from the sealing device, the valve assembly blocking fluid flow through the bore; a buoyant chamber formed between the sealing device and the valve assembly, the buoyant chamber including a fluid having a lower specific gravity than a fluid in the wellbore.

In one or more embodiments described herein, the sealing element includes a dome, and a convex surface of the dome is oriented upward, and the concave surface of the dome is oriented downward toward the valve assembly.

In one or more embodiments described herein, the tubular assembly includes a circulation tool having an injection tube with a tapered bore.

In another embodiment, a tubular assembly disposed in a wellbore includes a tubular string having a bore; a lower sealing device disposed in the tubular string and blocking fluid flow through the bore; an upper sealing device disposed in the tubular string and located upstream from the lower sealing device, the upper sealing device blocking fluid flow through the bore.

In one embodiment, the upper sealing device includes a tubular body having a bore; a frangible sealing element disposed in the tubular body and blocking fluid communication through the bore of the tubular body, the sealing element includes a dome having a concave surface oriented toward the lower sealing device; and a buoyant chamber formed between the lower sealing device and a upper sealing device, the buoyant chamber including a fluid having a lower specific gravity than a fluid in the wellbore.

In one or more embodiments described herein, the upper sealing device includes an aperture formed through the dome; and a rupture device selectively blocking fluid communication through the aperture.

In one or more embodiments described herein, the sealing element of the upper sealing device is seated in a collet seat releasably attached to the tubular body.

In one or more embodiments described herein, the collet seat is movable into contact with a portion of the tubular body to cause the sealing element to shatter.

In one or more embodiments described herein, the lower sealing device includes a tubular body having a bore; a plug housing coupled to the tubular body; a plug releasably attached to the plug housing and blocking fluid flow through the plug housing.

In one or more embodiments described herein, the tubular assembly includes a valve assembly disposed between the upper sealing device and the lower sealing device.

In one or more embodiments described herein, the lower sealing device includes a tubular body having a bore; and a frangible sealing element disposed in the tubular body and blocking fluid communication through the bore of the tubular body, the sealing element includes a dome having a concave surface oriented toward the upper sealing device.

In another embodiment, a method of installing a tubular string in a wellbore includes forming a buoyant chamber between a sealing device and a valve assembly disposed in the tubular string. The sealing device includes a tubular body having a bore; a frangible sealing element disposed in the tubular body and blocking fluid communication through the bore of the tubular body, the sealing element includes a dome and an aperture formed through the dome; and an aperture formed through the dome, the aperture blocked from fluid communication. The method also includes supplying the buoyant chamber with a fluid having a lower specific gravity than a fluid in the wellbore; moving the tubular string along the wellbore; applying pressure to open the aperture for fluid communication; and flowing fluid through the aperture to break the sealing element.

In one or more embodiments described herein, the method includes circulating at least a portion of the lower specific gravity fluid out of the buoyant chamber.

In one or more embodiments described herein, the method includes blocking fluid communication through the tubular string by installing a lower sealing device at a location downstream from the valve assembly.

In one or more embodiments described herein, the method includes supplying pressure to open the lower sealing device for fluid communication after circulating at least the portion of the lower specific gravity fluid out of the buoyant chamber.

In one or more embodiments described herein, the lower sealing device is one of a frangible sealing element and a releasable plug.

In one or more embodiments described herein, the method includes supplying cement through the valve assembly.

While the foregoing is directed to embodiments of the present disclosure, other and further embodiments of the disclosure may be devised without departing from the basic scope thereof, and the scope thereof is determined by the claims that follow.

The invention claimed is:

1. A sealing device, comprising:

a tubular body having a bore;

a collet seat having a plurality of collets releasably coupled to the tubular body;

a frangible sealing element disposed in the collet seat and blocking fluid communication through the bore, the collet seat longitudinally supporting the frangible sealing element in the tubular body; and a releasable sleeve releasably attached to the tubular body and retaining the collet seat against the tubular body, wherein the collet seat is longitudinally movable relative to the tubular body upon release from the tubular body, wherein the collet seat is in a first longitudinal position when retained by the sleeve, and wherein the collet seat, when released from the sleeve, is movable to a second longitudinal position while supporting the sealing element.

2. The device of claim 1, wherein the frangible sealing element breaks when the collet seat reaches the second position.

3. The device of claim 2, wherein the collet seat contacts a shoulder in the tubular body when the collet seat reaches the second position.

4. The device of claim 1, further comprising an annular chamber formed between the sleeve and the tubular body.

5. The device of claim 4, further comprising a port for fluid communication between the annular chamber and an exterior of the tubular body.

6. The device of claim 1, wherein the frangible sealing element comprises a frangible material selected from the group consisting of ceramics, metals, glass, porcelains, carbides, and combinations thereof.

7. The device of claim 1, wherein the frangible sealing element comprises a dome.

8. The device of claim 1, wherein each collet includes a collet head engaged with a groove formed in the tubular body.

9. The device of claim 8, wherein the releasable sleeve, in a first position, prevents the collet head from disengaging from the groove, and, in a second position, allows the collet head to disengage from the groove.

10. The device of claim 9, wherein the second position of the sleeve is located higher than the first position of the sleeve relative to the groove.

11. The sealing device of claim 1, wherein the frangible sealing element is longitudinally movable with the collet seat.

12. The sealing device of claim 1, wherein the releasable sleeve is configured to move in an opposite longitudinal direction as the collet seat to release the collet seat.

13. The sealing device of claim 1, wherein the collet seat includes a collet head engaged with a groove formed in the tubular body, and wherein the releasable sleeve prevents the collet head from disengaging from the groove.

14. A tubular assembly disposed in a wellbore, comprising:

a tubular string having a bore;

a sealing device of claim 1 disposed in the tubular string and blocking fluid flow through the bore of the sealing device;

a valve assembly disposed in the tubular string and downstream from the sealing device, the valve assembly blocking fluid flow through the bore of the tubular string;

a buoyant chamber formed between the sealing device and the valve assembly, the buoyant chamber including a fluid having a lower specific gravity than a fluid in the wellbore.

15. The tubular assembly of claim 14, wherein the frangible sealing element of claim 1 comprises a dome, and a convex surface of the dome is oriented upward, and the concave surface of the dome is oriented downward toward the valve assembly.

16. The tubular assembly of clam 14, further comprising a circulation tool having an injection tube with a tapered bore.

17. A tubular assembly disposed in a wellbore, comprising:

a tubular string having a bore;

a lower sealing device disposed in the tubular string and blocking fluid flow through the bore of the tubular string;

an upper sealing device disposed in the tubular string and located upstream from the lower sealing device, the upper sealing device blocking fluid flow through the bore of the tubular string, wherein the upper sealing device includes:

a tubular body having a bore;

a frangible sealing element disposed in the tubular body and blocking fluid communication through the bore of the tubular body, the frangible sealing element includes a dome having a concave surface oriented toward the lower sealing device; and a collet seat longitudinally movable relative to the tubular body, wherein the frangible sealing element is longitudinally supported by the collet seat in the tubular body and is longitudinally movable with the collet seat;

a releasable sleeve releasably attached to the tubular body and retaining the collet seat against the tubular body, wherein the collet seat is longitudinally movable relative to the tubular body upon release from the tubular body, wherein the collet seat is in a first longitudinal position when retained by the sleeve, and wherein the collet seat, when released from the sleeve, is movable to a second longitudinal position while supporting the sealing element; and a buoyant chamber formed between the lower sealing device and a upper sealing device, the buoyant chamber including a fluid having a lower specific gravity than a fluid in the wellbore.

18. The tubular assembly of claim 17, wherein the collet seat is movable into contact with a portion of the tubular body to cause the frangible sealing element to shatter.

19. The tubular assembly of claim 17, wherein the lower sealing device includes:

a tubular body having a bore;

a plug housing coupled to the tubular body;

a plug releasably attached to the plug housing and blocking fluid flow through the plug housing.

20. The tubular assembly of claim 17, wherein the lower sealing device includes:

a tubular body having a bore; and a frangible sealing element disposed in the tubular body and blocking fluid communication through the bore of the tubular body, the frangible sealing element includes a dome having a concave surface oriented toward the upper sealing device.

21. The tubular assembly of claim 17, further comprising a valve assembly disposed between the upper sealing device and the lower sealing device.

* * * * *